US009687905B2

(12) United States Patent
Knewtson et al.

(10) Patent No.: US 9,687,905 B2
(45) Date of Patent: Jun. 27, 2017

(54) SINUOUS SPRING FOR A FURNITURE ITEM

(71) Applicant: L & P PROPERTY MANAGEMENT COMPANY, South Gate, CA (US)

(72) Inventors: Kelly M Knewtson, Joplin, MO (US); William York, III, Carthage, MO (US); David William McCune, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 297 days.

(21) Appl. No.: 14/470,542

(22) Filed: Aug. 27, 2014

(65) Prior Publication Data

US 2016/0059299 A1 Mar. 3, 2016

(51) Int. Cl.
*B21F 1/04* (2006.01)
*B21F 35/04* (2006.01)

(52) U.S. Cl.
CPC ..... *B21F 1/04* (2013.01); *B21F 35/04* (2013.01)

(58) Field of Classification Search
CPC .... B21F 1/00; B21F 1/04; B21F 5/005; B21F 33/00; B21F 35/04
See application file for complete search history.

(56) References Cited

U.S. PATENT DOCUMENTS

| | | | |
|---|---|---|---|
| 2,645,252 | A | 7/1953 | Norman |
| 2,778,385 | A | 1/1957 | Gier, Jr. |
| 2,874,731 | A | 2/1959 | Smith |
| 3,071,168 | A | 1/1963 | Surletta |

OTHER PUBLICATIONS

International Search Report with Written Opinion dated Nov. 4, 2015 in Application No. PCT/US2015/045700, 10 pages.
International Preliminary Report on Patentability dated Mar. 9, 2017 in International Application No. PCT/US2015/045700, 6 pages.

*Primary Examiner* — Teresa M Ekiert
(74) *Attorney, Agent, or Firm* — Shook, Hardy & Bacon L.L.P.

(57) ABSTRACT

A sinuous spring for a furniture item includes various elements. For instance, a sinuous spring might include bars that are both parallel and non-parallel. The parallel bars might be positioned in a middle segment, and the non-parallel bars might be positioned in opposing end spring segments. A sinuous spring might be fabricated using various devices and methods, such as a wire-fabricating apparatus including a wire-forming mechanism and a length-adjusting mechanism. The wire-forming mechanism includes one or more sets of wire-forming dies that receive a continuously fed wire and that form the wire into a wire-shape configuration (e.g., sinuous-shape configuration). The length-adjusting mechanism includes a set of grooved wheels that receive the formed wire in the grooves and rotate to stretch or compress the formed wire.

20 Claims, 6 Drawing Sheets

SINUOUS SPRING FOR A FURNITURE ITEM

BACKGROUND

Sinuous wire springs have a long history of being used in furniture items, such as various seating units. They are known in the industry to serve various functions with a relatively minimum amount of wire, which can translate into lower costs. A sinuous wire spring is made up of a series of parallel "bars" connected by a series of semi-circular "loops" to form a serpentine-like configuration. Often a pre-determined number of bars and loops are used to create a sinuous spring of a specific length. The two ends of the sinuous spring are typically terminated in a "safety end", to keep the spring from slipping out of its rail attachment clip, or in a specialty end designed for attachment to metal rails, for instance.

Sinuous springs might be fabricated using various techniques. For example, the loops might be bent, stamped, or formed into the wire. Commonly, once the wire is formed into a sinuous configuration, the entire spring is further formed into a circular shape of a given radius, and put through a stress relief process. Many options of gauge of wire and finished length of the spring are available to suit various applications.

Sinuous springs are typically installed in a wood or metal frame by pulling the spring between the front and back rails of the frame, creating tension on the spring due to the un-coiling of the circular shape, and some stretching of the overall spring. The performance of the sinuous spring is primarily due to the torsion action of the flat bars of the spring. Sinuous springs are typically unitized in the seat frame by connecting them together by means such as metal hooks, or by clipping one or more pieces of paper or plastic covered "stake wire" to the flat bars of the sinuous, across the width of the seat, so that the individual sinuous will be tied together to act in a more unified fashion.

In some arced springs, when the spring is pulled between the rails, the arc of the spring is never pulled completely flat, creating a crown to the sinuous spring that adds to the ride and liveliness of the seat, as well as to the durability. But the radius of the spring can be increased in the stress relief process, in which case the crown of the seat is reduced. When the spring is manufactured flat, or very nearly flat, then the crown of the seat is eliminated. Reducing the radius or providing a flat spring can reduce the performance of the seat, but are sometimes chosen because the springs can be easier to handle and install.

SUMMARY

An embodiment of the present invention is directed to a sinuous spring having both parallel bars and non-parallel bars. For example, the spring might include a middle segment having parallel bars and opposing end spring segments that include non-parallel bars.

Another embodiment of the present invention is directed to a wire-fabricating apparatus that includes a wire-forming mechanism and a length-adjusting mechanism. The wire-forming mechanism includes one or more sets of wire-forming dies that receive a continuously fed wire and that form the wire into a wire-shape configuration (e.g., sinuous-shape configuration). The length-adjusting mechanism includes a set of grooved wheels that receive the formed wire in the grooves and rotate to stretch or compress the formed wire. For example, the grooved wheels might be rotated at variable speeds that are programmed to stretch the formed wire, or the wheels might be rotated at a similar speed with an angular offset in respective timing.

Another embodiment of the present invention includes a method of fabricating a wire spring, including feeding a wire between two sets of complementary wire-forming dies. The wire is formed into a wire-shape configuration by moving one or more of the complementary wire-forming dies along respective tracks and causing the two sets of complementary wire-forming dies to interlock. The formed wire is then fed below an upper set of one or more grooved wheels and/or above a lower set of one or more grooved wheels, the formed wire being received in one or more grooves of the grooved wheels. In addition, the formed wire is stretched or compressed by controlling the speed or angular offset of the two or more wheels included in the upper set, the lower set, or a combination thereof, while the wire is received in the one or more grooves.

Embodiments of the invention are defined by the claims below, not this summary. A high-level overview of various aspects of the invention is provided here to introduce a selection of concepts that are further described below in the detailed-description section. This summary is not intended to identify key or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached drawing figures, which are incorporated herein by reference, wherein.

DETAILED DESCRIPTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

Figure 6:
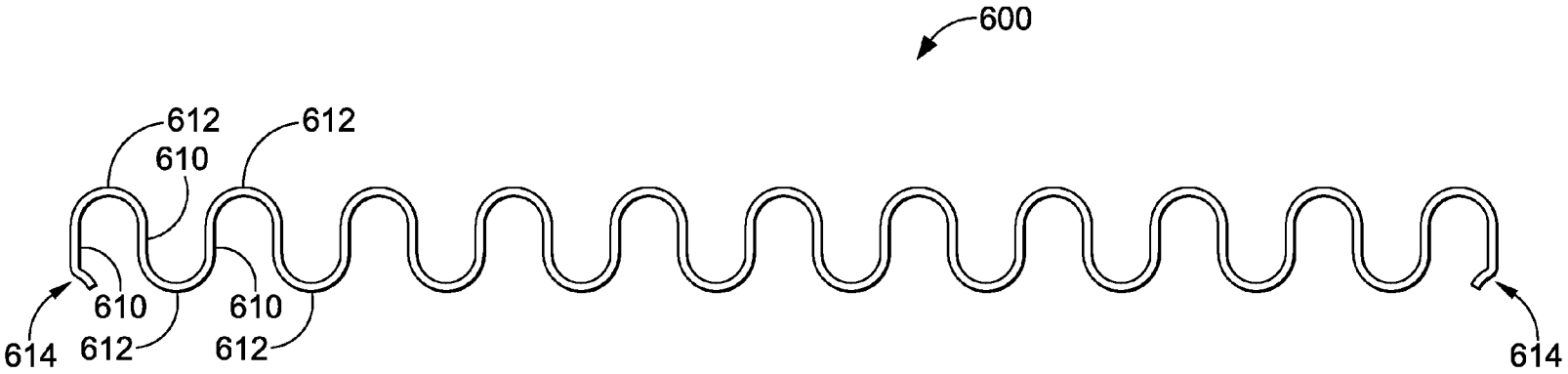
FIG. 6 depicts an exemplary sinuous spring.

Referring briefly to FIG. 6, an exemplary sinuous spring 600 is illustrated. The sinuous spring 600 includes a series of bars 610 that are substantially parallel to one another and that are connected by a series of loops 612. In addition, each end of the spring 600 includes a bend 614 that can be used to attach the spring 600 to a furniture item.

Figure 1:
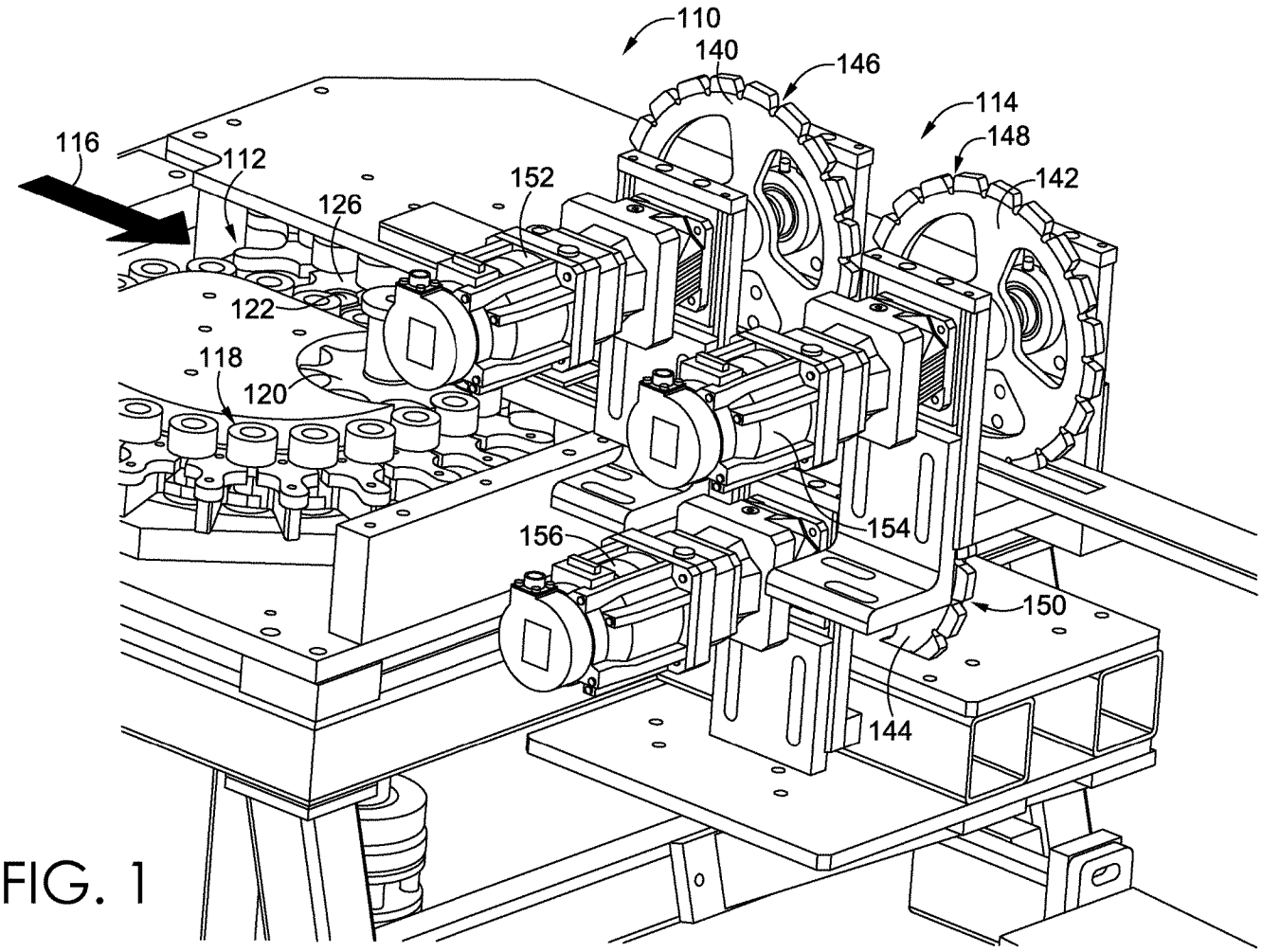
FIGS. 1-3 depict various alternative views of a wire-fabricating apparatus in accordance with an embodiment of the present invention.
Figure 2:
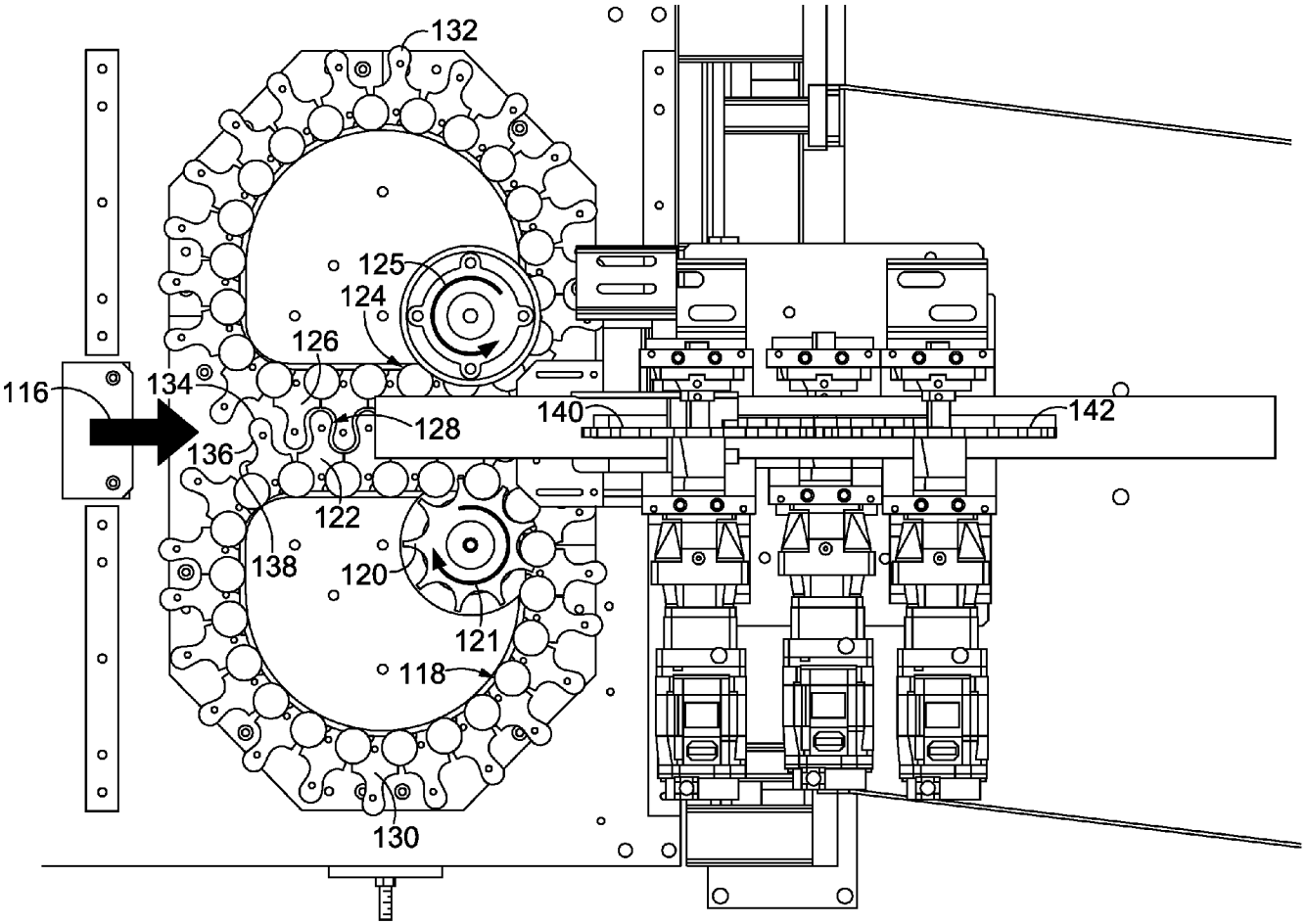
Figure 3:
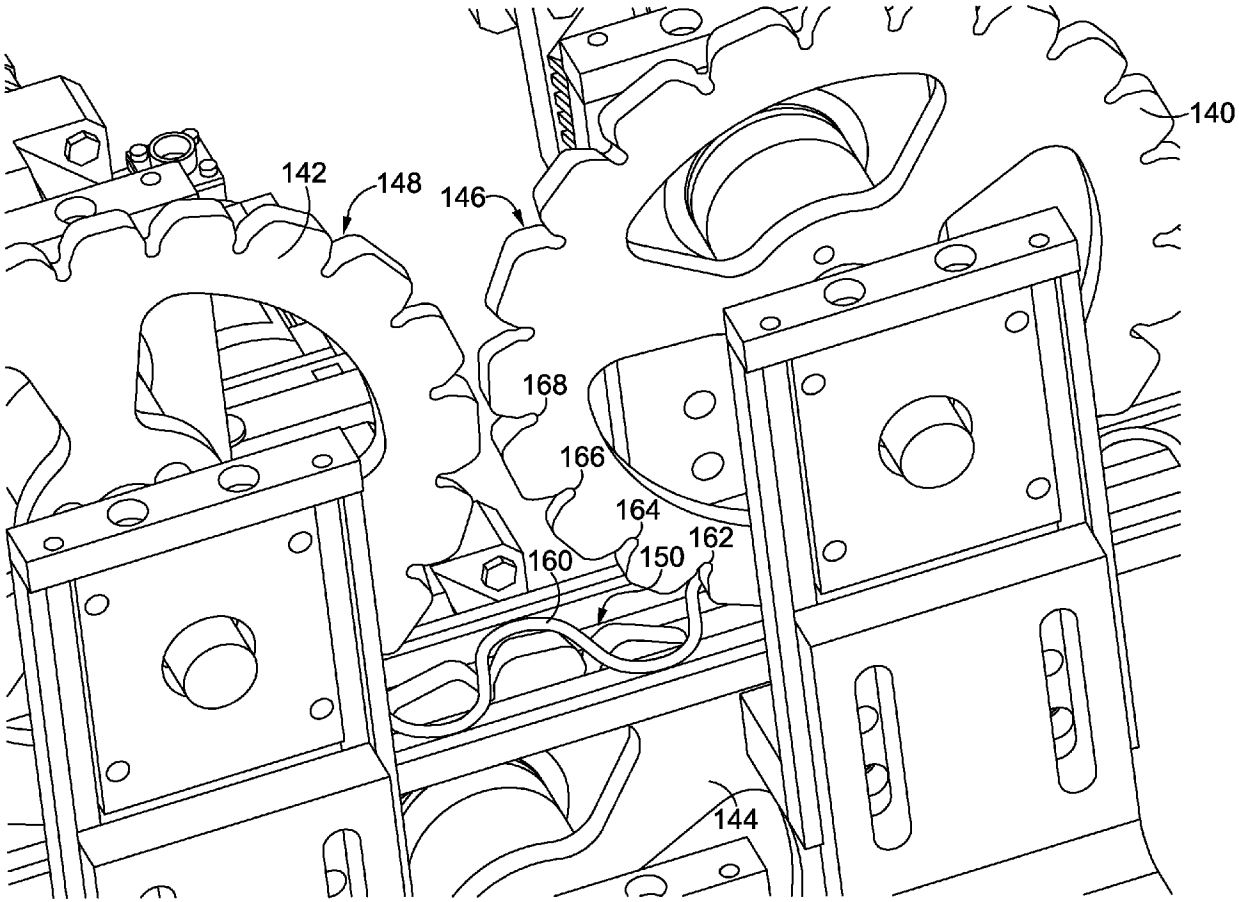

The spring 600 might be fabricated using various techniques, and illustrative components of a spring-fabricating apparatus are depicted in FIGS. 1-3. In general, a continuous feed of wire is supplied into a forming apparatus. Once formed into a desired shape, a length of the formed wire can be adjusted, such as by lengthening or compressing the wire. The formed wire can then be cutoff to a desired length and bent at the ends. The cut spring might then be roll formed, if an arc is desired, and stacked with other formed springs. Again, this is a general description of how a spring might be fabricated, and a more detailed explanation of the methods and apparatuses for fabricating a spring are provided hereinafter in this disclosure.

Referring now to FIGS. 1-3, a spring-fabricating apparatus 110 is depicted that includes a wire-forming mechanism 112 and a length-adjusting mechanism 114. The spring-fabricating apparatus 110 might be used to fabricate a spring having the same configuration as the sinuous spring 600, as well as other types of sinuous springs that have different and variable configurations (e.g., FIGS. 4A and 4B). Generally, a wire-feed apparatus (not depicted) is provided that can provide a continuous feed of wire (e.g., from a spool) to the spring-fabricating apparatus 110. Often, the wire passes through a wire-straightening mechanism (not depicted) before being fed to the spring-fabricating apparatus 110. Arrow 116 illustrates a portion of the wire-forming mechanism 112 into which the wire is fed. It should be noted that the relative positions of the wire-forming mechanism 112 and the length-adjusting mechanism 114 in FIGS. 1-3 are illustrative, and in operation, the positions might be changed. For example, the mechanisms might be spaced and aligned in a certain manner to allow the formed wire to exit from the mechanism 112 and enter the mechanism 114.

In the figures, the wire-forming mechanism 112 includes a wire-forming chain 118 mounted on a track 120. In addition, the wire-forming chain 118 includes a set of wire-forming dies (e.g., 122 and 130). Each die includes a wire-shape configuration. The wire-forming chain 118 is moved in the direction of arrow 121 (i.e., clockwise in FIG. 2). For example, the chain 118 might be mounted on a sprocket that is rotated using a servo motor or some other drive mechanism.

In one embodiment, the wire-forming mechanism 112 includes another wire-forming chain 124 having another set of wire-forming dies 126 that is complementary to, and aligned with, the set of wire-forming dies 122. The wire-forming chain 124 and dies 126 are moved in the direction of arrow 125 (i.e., counterclockwise in FIG. 2), which is opposite to the direction of the arrow 121. For example, the wire-forming chain 124 might be actively moved by its own respective servo motor, or the wire-forming chain 124 might be driven by the motion of the other wire-forming chain 118. As depicted in FIG. 2, the set of wire-forming dies 122 and the other set of wire-forming dies 126 are horizontally aligned and interlock with one another to create a form for shaping the wire when the tracks and dies are moved in respective directions.

In FIG. 2, the form is illustrated as a space 128 that is between the first set of dies 122 and the second set of dies 122, and the space 128 includes a sinuous configuration. Each die includes a respective loop-forming portion 134, a respective bar-forming portion 136, and a base portion 138. As such, when a wire is fed into the wire-forming mechanism 112 and the dies 122 and 126 are rotated in respective directions, the dies 122 and 126 interlock to form the wire into the wire-shape configuration. That is, the loop-forming portion of one die is pressed into the base portion of opposing dies. The base portions of the opposing dies are complementary to the loop-forming portion.

In one embodiment, the dies 122 and 126 interlock to form a wire into a sinuous spring 600 depicted in FIG. 6. In addition, the dies 122 and 126 could be alternatively designed to form a variety of different shapes. For example, loop-forming portions might be made bigger or smaller and with different sized radii. In addition, the bar-forming portions might be formed substantially parallel to one another, or alternatively might be angled with respect to one another. In one embodiment, the dies on the forming chain are designed to over-bend the wire to allow for wire spring back. For instance, if a parallel-bar spring is desired, then each die might be constructed to include bar-forming portions that bend the bars of a loop slightly beyond parallel (i.e., to include a smaller radius), in which case the inherent spring-back quality of the wire causes the bar portions to adjust to a parallel orientation.

In one embodiment, a die 130 or 132 in one portion of the set of dies is substantially similar to a die 122 or 126 (respectively) in another set of dies. That is, when a uniform spring is desired, all of the dies on a chain might create a substantially identical form. In an alternative embodiment, the die 130 or 132 might be different than the dies 122 or 126, such that a variable spring is formed. In other words, in some instances a variable loop product is desired that includes loops and bars having different configurations within the same spring. As such, dies within the same chain might have different configurations, which allow a formed spring to include variable loops and bars.

In another embodiment, it is desirable to modify a length of all of, or part of, a sinuous spring after it has been formed. As such, a sinuous spring can be fed into the length-adjustment mechanism 114 to compress or stretch the spring. The length-adjustment mechanism includes a series of grooved wheels 140, 142, and 144. In FIGS. 1-3, the length-adjustment mechanism 114 includes three wheels, but in other embodiments, the length-adjustment mechanism 114 might include two wheels or might include more than three wheels.

The wheels are positioned in a substantially similar plane, as depicted in FIG. 2. In addition, in the figures, the wheels include a top set of one or more wheels 140 and 142 and a bottom set of one or more wheels 144. The top set and the bottom set are arranged, such that a sinuous-shaped wire (e.g., 160 in FIG. 3) can be fed directly beneath the top set of wheels and directly on top of the bottom set of wheels.

Although the figures depict two top wheels and one bottom wheel, the top set might include one wheel or more than two wheels, and the bottom set might include a plurality of wheels. In addition, the length-adjustment mechanism might include only top wheels or only bottom wheels.

In one embodiment, the grooves of each wheel are timed to correspond with a pattern created by the dies of the wire-forming mechanism 112, such as a sinuous-shape pattern. For example, in FIG. 3 the grooves 162, 164, 166, and 168 are spaced apart to correspond with bars of the sinuous spring 160, which was formed by the wire-forming mechanism 112. In addition, each groove might include an orientation (relative to the axis of rotation) to correspond with an angle of the sinuous-spring bar. For instance, when receiving a sinuous spring having substantially parallel bars, the grooves of the wheel might be substantially parallel with the axis of rotation. Alternatively, when the wheel is receiving a sinuous spring that has angled bars, the groove (and tooth) might be angled relative to the axis of rotation, such as in a helical gear.

In a further embodiment, each wheel is coupled to a drive mechanism 152, 154, and 156, such as a servo motor. The drive mechanism might include variable speeds in which the respective speed of each of wheels 140, 142, and 144 might be independently controllable, such that the wheels are rotatable at different speeds. Or the drive mechanisms might include a respective single speed.

The length-adjustment mechanism 114 might be operated in various manners to stretch or compress a formed spring. In one embodiment, when a sinuous-shaped spring is positioned or fed in the grooves of the wheels, such as depicted in FIG. 3, rotating the wheels 140, 142, and 144 at different speeds can cause a radius of the spring loops (e.g., 161) to be decreased or increased. For example, in FIG. 3, if the wheel 142 is rotated faster than the wheel 144, then a radius of the loop 161 is increased and the overall length of the spring is increased. In an alternative embodiment, the wheels might be rotated at the same speed, but are offset by a programmable angle in relation to one another to stretch or compress the formed wire. Such an offset might be operator controlled on the operator interface to control angular difference between the wheel timing. For example, referring to FIG. 3, the grooves of wheel 140 might be angularly offset from the grooves of wheel 142, such that the grooves of one wheel is pulling or pushing relative to the grooves of the other wheel.

Once the formed wire is fed from the length-adjusting mechanism, the formed wire might be acted upon by various other machines or mechanism. For example, in one embodiment, the formed wire is fed into an accumulator, which serves as a buffer before the formed wire is passed to another mechanism. For example, the accumulator might provide a buffer before the formed wire is fed to a cut-off press. In this instance, the feed of the formed wire might be stopped so that the formed wire can be cut to a desired length and the ends formed into safety ends. In one embodiment, the forming apparatus 112 continues to run even when the feed for the formed wire is stopped to allow for cutting and bending. As such, the controls for the various devices, such as the forming apparatus 112, length-adjustment device 114, and accumulator must be appropriately configured to reduce the likelihood that the accumulator will be over-filled. In one embodiment, the speeds and feeds are manipulated through the operator interface to achieve a smooth-flowing loop of accumulated sinuous wire inside the accumulator, which allows the forming mechanisms to run constantly while the cut-off-press feed runs intermittently.

Accordingly, the formed wire might be fed into a cut-off press, which cuts the formed wire to a desired length an forms the ends of the wire (e.g., safety ends). After being cut to a desired length, the formed wire might be roll-formed to include a desired curvature. That is, the formed wire might be forced over a mandrel to create an arc in the formed spring. An example of one type of roll-forming device is described by U.S. Pat. No. 7,954,349, and a similar device might also be used in combination with the forming apparatus 112 and length-adjustment apparatus 114. For instance, a belt might be used to force the formed wire over the mandrel, and the belt might include various elements. In one embodiment, the belt includes a combination of a cog-type drive belt and an abrasion-resistant conveyor belt, which are laminated back-to-back. The cog-type drive belt is used to drive the belt, and the abrasion-resistant conveyor belt is used to engage and form the wire around the mandrel. These various mechanisms and devices can be configured in various manners to create a spring having desired specifications.

Once a spring has been roll-formed to include a desired curvature, the spring is stacked together with a series of other springs for distribution and eventual assembly. Stacking and handling might be facilitated in various manners. For instance, a mechanism similar to the nesting-stacking machine described in U.S. Pat. No. 7,954,349 is utilized, and multiple machines might be used depending on how fast the fabrication process is executed. As such, in one embodiment, the fabrication line includes a diverter chute, which directs each spring to a respective nesting-stacking machine. In another aspect, the roll forming and stacking could be separate into different portions of the overall process.

Figure 4A:
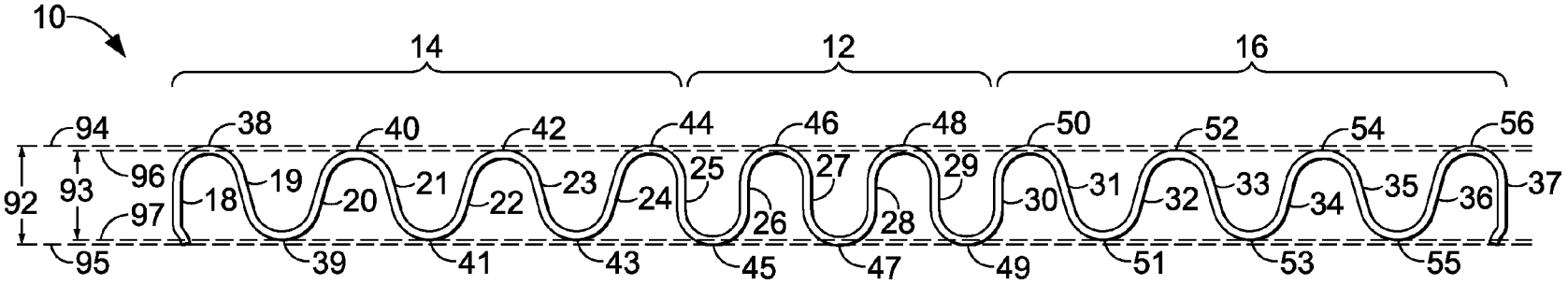
FIGS. 4A and 4B each depict a variable-loop sinuous spring in accordance with an embodiment of the present invention.
Figure 4B:
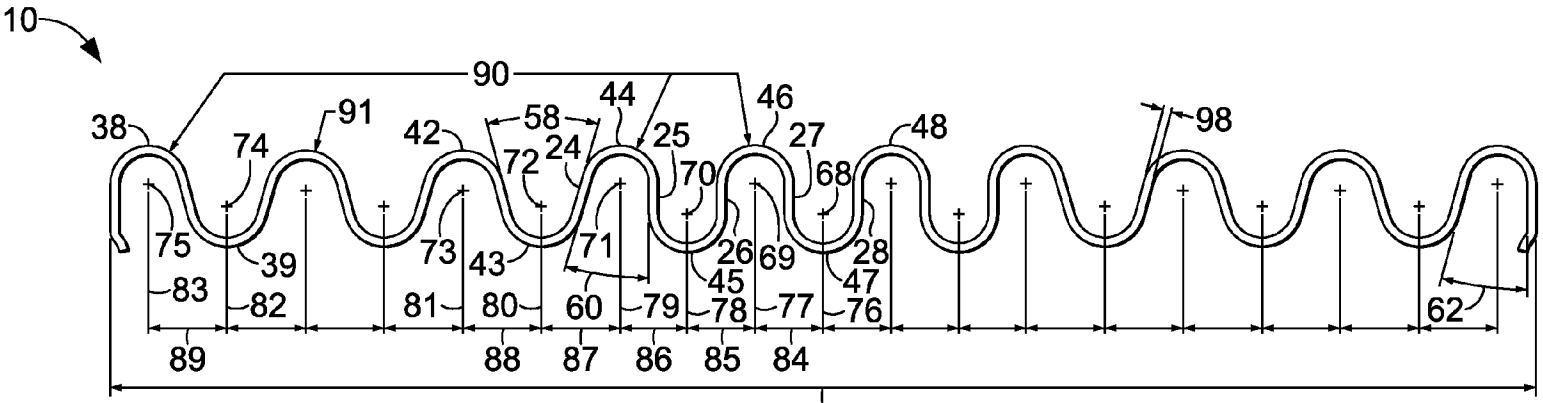

Turning now to FIGS. 4A and 4B, an embodiment of the present invention is directed to a sinuous spring that includes a middle segment and opposing-end segments. In the middle segment, the bars are positioned substantially parallel to one another, and in the end segments the bars are angled. By angling the bars in the end segment, less wire is used to construct the sinuous spring, which can reduce costs. In addition, including parallel bars in the middle segment, which is sometimes a performance-critical segment of the spring, preserves spring performance. Parallel bars also allow standard installation of stake wire once the springs are installed in the frame.

A sinuous spring 10 is depicted that includes a middle segment 12, a first end segment 14, and a second end segment 16. The sinuous spring 10 includes a series of bars 18-37 that are connected by a series of semi-circular loops 38-56. The middle segment includes a series of bars 25-30; the first end segment 14 includes a series of bars 18-24; and the second end segment includes a series of bars 31-37. The bars 25-30 of the middle segment are substantially parallel to one another, whereas the bars 18-24 are angled with respect to one another and the bars 31-37 are also angled.

Each of the bars in the end segments are oriented at an angle 58, 60, or 62 respective to an adjacent bar. For example, the bars 23 and 24 are arranged at angle 58 with respect to one another. In FIG. 4A, the angle 58 is consistent throughout the end segments, with the exception of the bars adjacent to the ends of the end segments. For instance, bars 36 and 37 are oriented at angle 62 with respect to one another, and angle 62 is smaller than angle 58. As depicted in FIG. 4A, bars 36 and 37 are included in the end segment 16. In addition, bars 24 and 25 are oriented at angle 60 with respect to one another, and angle 60 is smaller than angle 58. In FIG. 4A bar 24 is included in the end segment 14, whereas bar 25 is included in the middle segment 12. As previously indicated, the bars 25-30 of the middle segment are substantially parallel to one another.

In one embodiment, the angle 58 is about 30 degrees, and the angles 60 and 62 are about 15 degrees. These angles are modifiable to achieve desired spring characteristics. For example, increasing the angle 58 might reduce the amount of wire used to construct a spring having a given overall length, thereby reducing materials costs to produce the spring 10, but might also modify the spring performance. In contrast, decreasing the angle 58 might increase both the amount of wire used to construct the spring and the materials costs, but might also enhance the spring performance.

In FIG. 4A, the middle segment 12 includes six bars and the end segments 14 and 16 each include a respective set of seven bars. But the number of bars in each segment might be modified to achieve desired spring characteristics. For example, increasing the number of bars in the end segments and reducing the number of bars in the middle segment might reduce the amount of wire used to construct a spring having a given overall length, thereby reducing materials costs to produce the spring 10, but might also alter the spring performance. In contrast, increasing the number of bars in the middle segment and reducing the number of bars in the ends segments might increase both the amount of wire used to construct the spring and the materials costs, but might also enhance the spring performance. In one embodiment, the middle segment 12 includes at least five bars and no more than seven bars, and each end segment 14 and 16 includes at least six bars and no more than eight bars. In a further embodiment, the spring includes 17 to 24 total bars.

In FIG. 4B, each bar is connected to one or more adjacent bars by one or more loops, and each loop includes a respective center point and radius. For instance, the bars 26, 27, and 28 are connected to one another by loops 46 and 47. Loop 46 includes a center point 69, and loop 47 includes a center point 68. In FIG. 4B, a reference line 76 is provided that is aligned with the center point 68, and a reference line 77 is provided that is aligned with the center point 69. In addition, center points 70, 71, 72, 73, 74, and 75 are depicted for loops 45, 44, 43, 42, 39, and 38 (respectively). For each of the center points 70-75, a respective reference line 78-83 is depicted in FIG. 4B.

When determining a configuration of the spring 10, one measurement includes a distance between reference lines. For example, FIG. 4B depicts a distance 84 between reference lines 76 and 77. In one embodiment the distance 84 is about 1.200 inches, which might be consistent across the middle section 12. In addition, FIG. 4B depicts a distance 85 between reference lines 77 and 78 that might also be about 1.200 inches. Distance 86 is also depicted in FIG. 4B and might also be about 1.200 inches. FIG. 4B also depicts distance 87 between reference lines 79 and 80. As previously indicated, bar 24 is angled relative to bar 25, such that the distance 87 might be greater than the distance 85 or 86, and in one embodiment, the distance 87 is about 1.388 inches. In addition, FIG. 4B includes a distance 88 between reference lines 80 and 81, and the distance 88 is about 1.393 inches. FIG. 4B further includes distance 89 between reference lines 82 and 83, and in one embodiment, distance 89 is substantially similar to distance 87 (e.g., about 1.388 inches). It should be noted that although only select parts of the spring might be described with respect to one of the end segments 14 and 16, the same description equally applies to the other end segment.

Another element that contributes to the configuration of the spring includes the radius of the loops. For example, reference numeral 90 points to some loops 38, 44, and 46 that have a similar radius, and in one embodiment, the radius of these loops is about 0.676 inches. The radius of other loops 45, 47, 48, 49, 50, and 56 would be substantially similar. In addition, reference numeral 91 identifies another loop 40, which has a radius that is bigger than the loops identified by reference numeral 90. In one embodiment, loops 39-43 and 51-55 have a radius of about 0.716 inches.

FIG. 4B identifies other exemplary dimensions, such as a first spring height 92 and a second spring height 93, and in FIG. 4B a height of the spring 10 varies from one end of the spring to the other end. The first height 91 depicts a height of the spring at each loop (e.g., 38, 44-50, and 56) that connects at least one parallel bar (e.g., 18, 25-30, and 37). The height 91 is measured from a first reference line 94 to a second reference line 95. Each reference line 94 and 95 is aligned with the outermost loop peaks on a respective side of the spring. In one embodiment, the first height 92 is about 1.875 inches. The second height 93 depicts a height of the spring at each loop that connects two angled bars (i.e., 19-24 and 31-36). The height 93 is measured from a third reference line 96 to a fourth reference line 97. Reference line 96 is aligned with peaks of the loops 40, 42, 52, and 54) and reference line 97 is aligned with the peaks of loops 39, 41, 43, 51, 53, and 55. In one embodiment, the second height 93 is about 1.6875 inches. In a further embodiment, the spring 10 includes a variable height that is in a range of about 1.6875 inches to about 1.875 inches.

FIG. 4B also depicts an overall length 99 of the spring. In one embodiment, the length 99 of the spring is about 25.25 inches.

The sinuous spring 10 might be referred to as a varied-loop spring based on the different loop configurations included within the same spring. The varied-loop spring might have slightly higher rail strain, and create a slightly firmer seat, than a consistent-loop spring (non-varied-loop spring) if both springs are produced in the same gauge. In one embodiment, the varied-loop spring is constructed of a wire having a lighter gauge, which creates a firmness and rail strain substantially similar to the non-varied-loop spring. For instance, the gauge 98 might be about 8.75 GA.

The spring 10 might be constructed using various methods. For example, the spring could be formed having consistent loops from one end to the other, and the two end portions 14 and 16 could be stretched. In an alternative embodiment, the spring is formed having varied loops by using a variable-loop die. In addition, after the varied-loop spring 10 is constructed, the spring 10 might be stress relieved in the flat condition, or any amount of desired arc could be added to the spring before stress relief.

Figure 5:
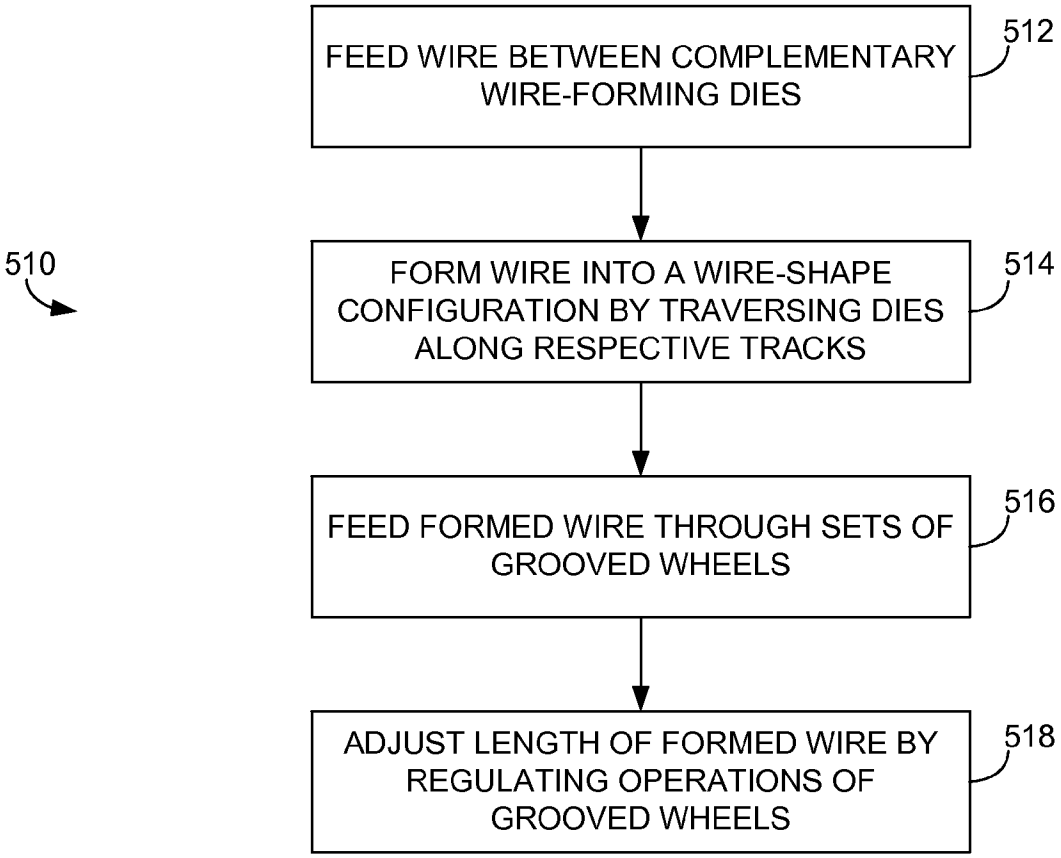
FIG. 5 includes a flow diagram that outlines steps of a method for fabricating a wire spring in accordance with an embodiment of the present invention.

Referring now to FIG. 5, a flow diagram depicts a method 510 of fabricating a wire spring. In describing the method 510, reference is also made to FIGS. 1-4B for illustrative purposes. At step 512, a wire is fed between two sets of complementary wire-forming dies. For example, a substantially straight wire might be fed in the direction of arrow 116 between the sets of dies 122 and 126. Step 514 includes forming the wire into a wire-shape configuration by traversing the two sets of complementary wire-forming dies along respective tracks and causing the two sets of complementary wire-forming dies to interlock. As previously explained, the dies 122 and 126 are moved in the respective directions of arrows 121 and 125, and the dies interlock to create a form 128, which shapes the wire. In step 516, the formed wire is then fed to a set of grooved wheels (e.g., below an upper set of one or more grooved wheels and/or above a lower set of one or more grooved wheels) as the wire is received in one or more grooves of the grooved wheels. For example, the wire 160 (FIG. 3) might be fed below wheels 140 and 142 and/or above wheel 144, and the wire 160 is received in grooves (e.g., 150 and 162) as the wire is pulled through the sets of wheels. Step 518 includes adjusting a length of the wire that has been formed by regulating an operation of the one or more grooved wheels, such as by controlling an angular offset of the one or more grooved wheels, a speed of the one or more grooved wheels, or a combination thereof, while the wire is received in the one or more grooves.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A wire-fabricating apparatus comprising:

a wire-forming mechanism that is positioned to receive a continuously fed wire and that comprises at least one wire-forming chain mounted on a track, the at least one wire-forming chain including a set of wire-forming dies, which includes a shape configuration; and a length-adjusting mechanism comprising a first grooved wheel and a second grooved wheel, each of which includes a respective set of grooves spaced to substantially match the shape configuration, wherein the first grooved wheel and the second grooved wheel are programmable to regulate a speed of rotation, an angular offset, or a combination thereof.

2. The wire-fabricating apparatus of claim 1, wherein the wire-forming mechanism includes another wire-forming chain having another set of wire-forming dies that is complementary to, and aligned with, the set of wire-forming dies, and wherein the set of wire-forming dies and the other set of wire-forming dies interlock with one another to create a form for shaping the wire.

3. The wire-fabricating apparatus of claim 2, wherein both the set of wire-forming dies and the other set of wire-forming dies are movable along a respective track to interlock various portions of the respective sets of dies.

4. The wire-fabricating apparatus of claim 3, wherein the set of wire-forming dies is mounted on a first sprocket and the other set of wire-forming dies is mounted on a second sprocket, and wherein the first sprocket and the second sprocket are rotatable in opposite directions to interlock the various portions of the respective sets of dies.

5. The wire-fabricating apparatus of claim 1, wherein the shape configuration is a sinuous-shape configuration having a loop-forming portion and a bar-forming portion.

6. The wire-fabricating apparatus of claim 1, wherein the set of dies includes dies having a consistent shape.

7. The wire-fabricating apparatus of claim 1, wherein the set of dies includes a first subset of dies that is attached to the wire-forming chain and that includes a first sinuous-shape configuration and wherein the set of dies includes a second subset of dies that is attached to the wire-forming chain and that includes a second sinuous-shape configuration, which is different than the first sinuous-shape configuration.

8. The wire-fabricating apparatus of claim 7, wherein the first sinuous shape configuration includes a parallel-bar configuration and the second sinuous-shape configuration includes a non-parallel bar configuration.

9. The wire-fabricating apparatus of claim 1, wherein the length-adjusting mechanism further comprises a third grooved wheel that includes a set of grooves spaced to substantially match the wire-shape configuration.

10. The wire-fabricating apparatus of claim 1, wherein the set of grooves of each wheel include a first subset of grooves extending substantially parallel with a rotation of axis and a second subset of grooves extending at an angle relative to the rotation of axis.

11. A wire-fabricating apparatus comprising:

a wire-forming mechanism comprising a first wire-forming chain and a second wire-forming chain that oppose one another and that are each mounted on a respective track, wherein the first wire-forming chain includes a first set of wire-forming dies and the second wire-forming chain includes a second set of wire-forming dies, and wherein the first and second sets of dies interlock with one another as the respective tracks are traversed to create a form for forming a continuously fed wire into a shape configuration; and a length-adjustment mechanism comprising a first grooved wheel and a second grooved wheel, each of which includes a respective set of grooves spaced to substantially match the shape configuration, wherein the respective set of grooves of the first grooved wheel include an angular orientation relative to the respective set of grooves of the second grooved wheel, and wherein the angular orientation is programmable to be offset.

12. The wire-fabricating apparatus of claim 11, wherein the shape configuration includes a sinuous-shape configuration having a series of bars connected by a series of loops.

13. The wire-fabricating apparatus of claim 12, wherein the first and second grooved wheels are aligned in a plane such that an axis of each grooved wheel is substantially parallel, and wherein the plane is substantially aligned with the form created by the interlocking dies.

14. The wire-fabricating apparatus of claim 13, wherein the length-adjustment mechanism positioned such that a formed wire exiting the wire-forming mechanism is fed below the first grooved wheel and the second grooved wheel.

15. The wire-fabricating apparatus of claim 14, wherein the grooves of the first and second wheels are timed to substantially match the series of bars of the sinuous-shape configuration, such that bars of the formed wire are received in the grooves as the formed wire is fed through the wire-fabricating apparatus.

16. A method of fabricating a wire spring comprising:

feeding a wire between two sets of complementary wire-forming dies;

forming the wire into a shape configuration by traversing the two sets of complementary wire-forming dies along respective tracks and causing the two sets of complementary wire-forming dies to interlock;

feeding the wire that has been formed into grooves of one or more grooved wheels, wherein the wire is received in one or more grooves of the grooved wheels; and adjusting a length of the wire that has been formed by controlling an angular offset of the one or more grooved wheels, a speed of the one or more grooved wheels, or a combination thereof, while the wire is received in the one or more grooves.

17. The method of claim 16, wherein forming the wire into the shape configuration includes forming the wire into a sinuous-shape configuration including a series of bars connected by a series of loops.

18. The method of claim 17, wherein the series of bars are received in the one or more grooves of the grooved wheels.

19. The method of claim 18, wherein adjusting the length includes offsetting a programmable angle of the one or more grooved wheels.

20. The method of claim 19, wherein forming the wire into the sinuous-shape configuration includes compensating for spring-back inherent qualities of the wire by bending the wire to an angle that exceeds a desired angle, wherein the angle that exceeds the desired angle is formed by the wire-forming dies.

* * * * *